United States Patent [19]

Werst

[11] 4,112,665

[45] Sep. 12, 1978

[54] PLURAL SENSOR ENDS DOWN DETECTING APPARATUS

[75] Inventor: Lyman L. Werst, Acton, Mass.

[73] Assignee: Parks-Cramer Company, Fitchburg, Mass.

[21] Appl. No.: 809,428

[22] Filed: Jun. 23, 1977

[51] Int. Cl.[2] ..... D01H 13/16

[52] U.S. Cl. ..... 57/81; 57/34 R; 250/561; 356/199

[58] Field of Search ..... 57/34 R, 81; 28/187; 340/259; 242/36, 49; 226/45; 73/160; 356/199; 250/561, 571

[56] References Cited

U.S. PATENT DOCUMENTS

| | | | |
|---|---|---|---|
| 3,672,143 | 6/1972 | Whitney | 57/34 R X |
| 3,772,524 | 11/1973 | Erbstein | 250/561 |
| 3,900,738 | 8/1975 | McKay, Sr. | 250/561 X |
| 3,902,308 | 9/1975 | Bernstein et al. | 57/34 R |

*Primary Examiner*—Charles Gorenstein

*Attorney, Agent, or Firm*—Bell, Seltzer, Park & Gibson

[57] ABSTRACT

An improved sensor arrangement for use in an apparatus which travels a detector along ttextilestrand processing machines such as spinning frames for determining the absence of ends of yarn from locations therealong at which such ends normally are present and for thereby locating ends down on the textile strand processing machines. The arrangement disclosed herein includes an optical system defining a light path for focusing light reflected from yarns and a plurality of sensors for receiving light passed along a common light path by the optical system and for generating pulse electrical signals in response to variations in illumination in respective, vertically spaced and aligned, fields of view.

6 Claims, 4 Drawing Figures

PLURAL SENSOR ENDS DOWN DETECTING APPARATUS

It is heretofore been proposed that the efficiency of operation in certain textile strand producing operations be improved by providing apparatus which detects and responds to the ends down condition of textile yarn or thread forming apparatus such as spinning and twisting machines. In accordance with such proposals, apparatus is provided within a textile mill room, such as a spinning room, for moving detector means along textile apparatus in a predetermined manner and for registering the response apparatus may be found in U.S. Pat. Nos. 3,099,829; 3,486,319; 3,523,413; 3,659,409 and 3,899,868; all owned in common with the present invention.

While the prior apparatus and methods described in the aforementioned U.S. patents have achieved success, continuing use and development of such apparatus has demonstrated that improper responses and false or inaccurate indications of ends down or broken yarns can arise under certain circumstances. Most typically, such false signals arise in circumstances where ambient lighting levels fluctuate or where ambient lighting levels are relatively high and reflection from textile machine elements other than yarns give the appearance of or override a yarn related signal.

With the above discussion in mind, it is an object of the present invention to minimize interference otherwise possibly occurring in determining the presence of yarns with a traveling detector. In realizing this object of the present invention, a plurality of pulse electrical signals are generated in response to variations in illumination in spaced and positionally related sensor fields of view. The plurality of pulse electrical signals are supplied to a logic circuit responsive to normal traversal of the traveling detector for distinguishing between signalling from all sensors within a predetermined time period and indicative of the presence of a yarn and signalling from less than all of the sensors and indicative of a fluctuation in ambient lighting or apparatus reflections.

Yet a further object of the present invention is to facilitate improved accuracy in determination of the absence or presence of yarns by seeking coincidence of sensor signals within determined time limits. In realizing this object of the present invention, a logic circuit includes a plurality of gate devices interconnected one with another and with a plurality of sensors. The gate devices function together as described more fully hereinafter, in such a way as to distinguish sensor signals of particular frequencies and amplitudes and to generate a signal indicative of the presence of a yarn upon the occurrence of coincidence or overlapping sensor signals having the appropriate frequencies and amplitudes.

Some of the objects having been stated, other objects will appear as the description proceeds, when taken in connection with the accompanying drawings in which.

While the present invention will be described more fully hereinafter with particular reference to the accompanying drawings, it is to be understood at the outset of the more detailed description of this invention that is contemplated that the specific details of an apparatus embodying this invention may be varied from those shown and to be described hereinafter. It is contimplated that the accompanying drawings and the following description be directed as a broad and enabling teaching to persons skilled in the appropriate arts, and not be limiting upon the scope of protection afforded for this invention.

Figure 1:
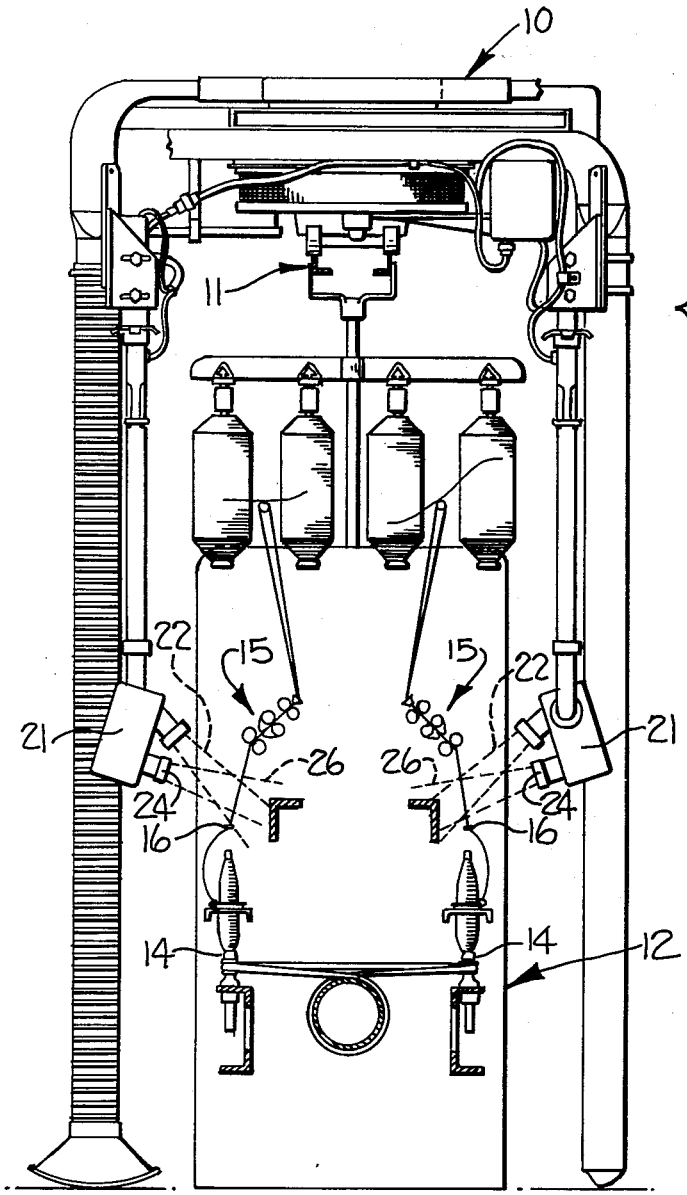
FIG. 1 is an end elevation view, partially in section, of a traveling pneumatic cleaner and spinning frame incorporating ends down detecting apparatus in accordance with the present invention.
Figure 2:
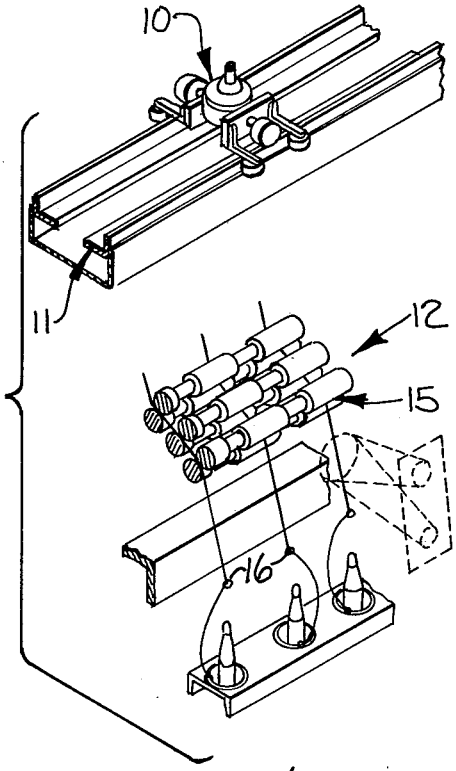
FIG. 2 is a perspective view, from one side and above, of certain portions of the structure illustrated in FIG. 1, showing an application of the present invention.

Referring now more particularly to the drawings, apparatus is there illustrated which travels detector means along textile strand processing machines such as spinning frames for detecting ends down conditions. As will be noted from FIG. 1, the present invention is particularly concerned with apparatus in which the travel of a detector means results from the combination of electrical circuit means with a traveling pneumatic cleaner generally indicated at 10 mounted on a track generally indicated at 11 for movement above and along a plurality of spindles on at least one textile strand processing machine such as a spinning frame generally indicated at 12. The advantages and benefits which flow from such a combination have been described in the aforementioned related U.S. patents. As the broad relationship of the traveling apparatus and textile strand processing machine may be fully understood from the disclosures in the aforementioned patents and the references therein made to other and further pertinent patent disclosures, the present description shall not repeat at length such discussion and disclosure, but is directed to particular improvements.

As is known to persons skilled in the appropriate arts and to readers of the aforementioned patents, a textile strand processing machine such as the spinning frame 12 has locations spaced therealong, at the spindles 14, at which ends of yarn pass from front delivery rolls of drafting systems generally indicated at 15 through stationary guides 16, to rotating guides such as travelers moving about spinning rings, and onto a package or bobbin being formed. As will be appreciated, a portion of the path of movement followed by an end of yarn presents the yarn moving generally along a line while another portion presents the yarn moving in a rotating balloon. The rate of rotation of the balloon of yarn imparts a vibrating motion or characteristic to the yarn in that portion of the path where the yarn is moving generally along a line.

In the apparatus of the present invention, a determination of the absence of ends of yarn from a textile strand processing machine such as the spinning frame is accomplished generally in accordance with operations as described in the aforementioned related U.S. patents, in that pulse electrical signals are generated in response to the presence of ends of yarn and are then processed through certain electrical circuits to report and/or register an ends down condition as required for a particular environment and installation. At least certain elements of an electrical circuit means used in accordance with the present invention will not here be described, but will be clear to persons of appropriate skill in the applicable arts and familiar with the disclosures of the aforementioned patents.

In accordance with the present invention, light may be directed against yarns from an appropriate lamp generally indicated at 20 traveling with the traveling apparatus 10 and mounted within a protective housing 21. Light emitted from the lamp 20 or the like is directed through an optical system into a field of illumination indicated by phantom lines 22 and toward yarns intermediate the delivery rolls of the drafting systems 15 and the pigtail guides 16.

Optical system means generally indicated at 24 defines a light path for focusing light reflected from the yarns. While shown as a single, simple lens, the optical system means 24 will take such forms as are appropriate to the operation of the present invention as described more fully hereinafter.

Mounted within the protective housing 21 in predetermined relation with the optical system means 24 are a plurality of photosensitive means, illustrated as two phototransistors 25A, 25B. The photosensitive means 25A, 25B receive light passed along a common light path by the optical system means 24. That is, each of the plurality of photosensitive means 25A, 25B views yarns through the common, single optical system means 24. However, the plurality of photosensitive means 25A, 25B are mounted for viewing separate, respective, vertically spaced and aligned, fields of view. That is, while the optical system means 24 has a relatively wide field of view as indicated by phantom lines 26, one of the photosensitive means (for example the upper phototransistor 25A) generates pulse electrical signals in response to variations in illumination in a lower portion of that field of view 26, while the other generates pulse electrical signals in response to variations in illumination in a vertically (upwardly, in this example) spaced and aligned portion thereof. As will be appreciated, traversal of the traveling unit 10 and the housing 21 adjacent a series of spindles 14 will traverse the field of view 26 of the optical system means 24 and the spaced portions thereof across a series of yarns. With the vertical spacing and alignment of the fields of view of the plurality of photosensitive means, each yarn moving through the fields of view gives rise to coincident or overlapping or nearly simultaneous generation of electrical pulse signals by the two phototransistors 25A, 25B.

Figure 3:
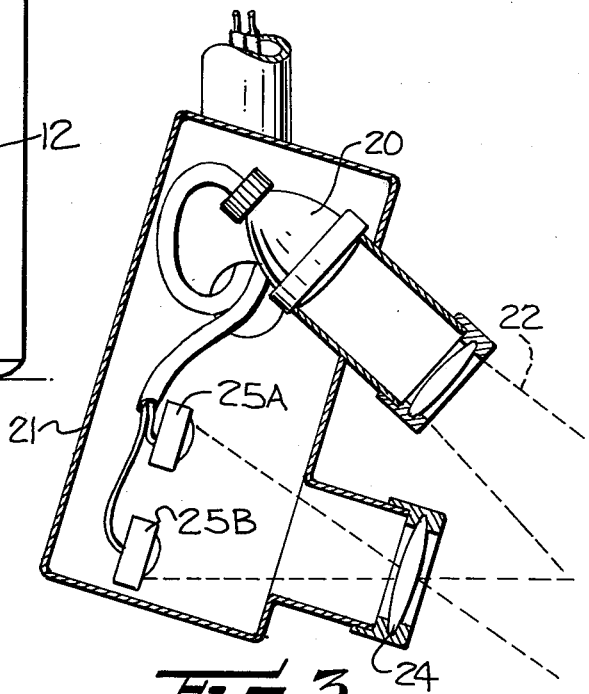
FIG. 3 is an enlarged, sectional view through a portion of the structure of FIG. 1.
Figure 4:
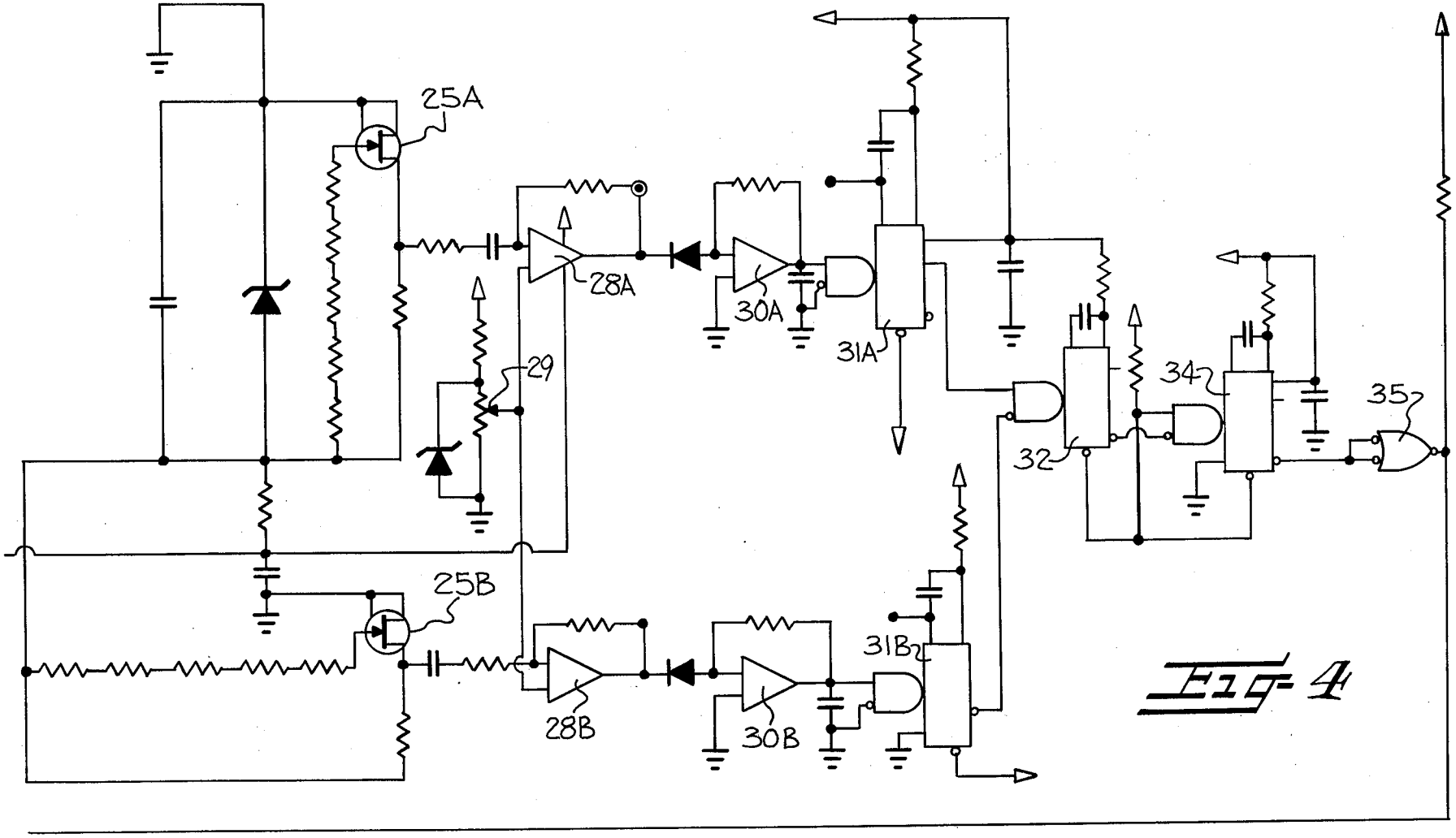
FIG. 4 is a schematic circuit diagram of an electrical circuit means for the apparatus illustrated in FIGS. 1-3.

In accordance with the present invention, logic circuit means are electrically connected to the photosensitive means for receiving pulse signals therefrom and are responsive to normal traversal of the photosensitive means fields of view for distinguishing between (a) signalling from all of the photosensitive means within a predetermined time period and indicative of the presence of a yarn and (b) signalling from less than all of the sensor means and indicative of a fluctuation in ambient lighting or an apparatus reflection. Such a circuit arrangement is illustrated in FIG. 4, where a pair of phototransistors 25A, 25B correspond to those shown in FIG. 3. Referring now more particularly to one phototransistor 25A, an output therefrom is connected with an inverting differentiator amplifier 28A. As the amplifier operates as a differentiator responding to a rate of change, the amplifier 28A has more gain in responding to a yarn signal than in responding to slowly varying background illumination. Thus, slow variations in background illumination are suppressed. Additionally, provision is made for an adjustable bias to be applied through a potentiometer 29, such that a signal threshold or necessary amplitude is established. An output from the differentiator amplifier 28A is coupled to a voltage comparator amplifier 30A which functions to apply a positive pulse to a one-shot multivibrator 31A in the event of an apparent yarn response signal from the phototransistor 25A. The one-shot multivibrator 31A is set to one of two conductive states by the pulse and, after a predetermined interval of time (for example 12 milliseconds), returns to its alternate state.

A similar signal channel including a differentiator amplifier 28B, voltage comparator amplifier 30B and multivibrator 31B is operatively connected with the second phototransistor 25B for similarly responding to an apparent yarn signal therefrom.

Outputs from the multivibrators 31A, 31B are supplied to an input gate for a coincidence multivibrator 32, in such a manner that the multivibrators 31A, 31B responsive to the phototransistors 25A, 25B and the input gate together comprise a coincidence circuit causing the coincidence multivibrator 32 to set only when at least some portion of outputs from the respective channel multivibrators 31A, 31B overlap in time. When set, the coincidence multivibrator 32 remains in its set condition for a predetermined interval of time (for example on the order of 40 milliseconds) and then returns to its other state. An output signal from the coincidence multivibrator 32 is passed through an output multivibrator 34 and a line driver device 35 to supply a yarn present signal to other and further cadence circuitry such as is described, for example, in aforementioned U.S. Pat. No. 3,659,409. Inasmuch as such other and further circuitry may take a variety of different forms and forms no major part of the present invention, such circuitry will not here be described at length and interested readers are instead referred to the aforementioned U.S. patent and other descriptions available to persons skilled in the applicable arts.

As will be apparent from the discussion above, generation of an electrical pulse signal by any one of the plurality of photosensitive means in response to variations in the illumination in its respective field of view will not lead to passage of a yarn present signal through the driver device 35, by operation of the coincidence circuit. However, generation of pulse electrical signals by all of the photosensitive means within a predetermined time period will result in such a pulse passing from the circuitry of FIG. 4, in accordance with the present invention. Experience has demonstrated that rapid fluctuations in ambient lighting and/or apparatus reflection typically does not cause variations in illumination in the vertically spaced and aligned fields of view of the plurality of photosensitive means within the predetermined time periods allowed and therefore will not interfere in the operation desired for the traveling apparatus incorporating the present invention.

In the drawings and specification, there has been set forth a preferred embodiment of the invention, and although specific terms are employed, they are used in a generic and descriptive sense only and not for purposes of limitation.

That which is claimed is:

1. In the combination of an elongate textile yarn forming machine having a plurality of yarn forming stations spaced therealong, and a traveling apparatus movable along the machine and having photoelectric detector means for sensing and responding to yarns formed at the stations, an improvement in said detector means which minimizes interference with detector means operation otherwise possibly resulting from ambient lighting or machine reflection, the improvement comprising a common optical system means for focusing light reflecting from yarns, a plurality of photoelectric sensor means mounted in vertical array for receiving light passing through said optical system means from vertically spaced locations and for signalling electrically fluctuations in light received, and electrical gate means operatively connected with said sensor means for distinguishing between (a) signalling from all of said sensor means within a predetermined time period and indicative of the presence of a yarn at said locations, and (b) signalling from less than all of said sensor means and indicative of a fluctuation in ambient lighting or machine reflection.

2. In an apparatus which travels detector means along an elongate textile strand processing apparatus such as a spinning frame for sensing yarns, electrical circuit means for determining the presence of yarns while minimizing interference otherwise possibly resulting from ambient lighting and reflection from apparatus elements and comprising:

optical system means defining a light path for focusing light reflected from yarns, a plurality of photosensitive means for receiving light passed along a common light path by said optical means and for generating pulse electrical signals in response to variations in illumination in respective, vertically spaced and aligned, fields of view, said optical means and said photosensitive means being mounted for traversal of said fields of view along a plurality of locations where yarns normally are present, and logic circuit means electrically connected to said photosensitive means for receiving pulse signals therefrom and responsive to normal traversal of said fields of view for distinguishing between (a) signalling from all of said photosensitive means within a predetermined time period and indicative of the presence of a yarn and (b) signalling from less than all of said photosensitive means and indicative of a fluctuation in ambient lighting or apparatus reflection.

3. Apparatus according to claim 2 wherein said photosensitive means comprises a pair of phototransistors mounted in vertical array.

4. Apparatus according to claim 2 wherein said logic circuit means comprises a plurality of signal conditioning circuit means each electrically connected to a corresponding one of said photosensitive means for responding to pulse signals generated thereby, said signal conditioning circuit means emitting signals in response to photosensitive means signals having frequency and amplitude characteristics indicative of generation in response to traversal of a yarn by the respective field of view.

5. Apparatus according to claim 2 wherein said logic circuit means comprises coincidence circuit means responsive to pulse electrical signals from said photosensitive means for emitting signals upon receipt of signals from each of said photosensitive means within a predetermined short interval of time, said coincidence circuit means comprising multivibrator means responsive to signals from said photosensitive means for setting a predetermined duration for each such photosensitive means signal and gate means electrically connected to said multivibrator means for distinguising simultaneous continuance of all such photosensitive means signals.

6. In an apparatus which travels detector means along an elongate textile strand processing apparatus such as a spinning frame for sensing yarns, electrical circuit means for determining the presence of yarns while minimizing interference otherwise possibly resulting from ambient lighting and reflection from apparatus elements and comprising:

a pair of photosensitive means for generating pulse electrical signals in response to variations in illumination in respective, vertically spaced and aligned, fields of view and mounted for traversal of said fields of view along a plurality of locations where yarns normally are present, a pair of signal conditioning circuit means each electrically connected to a corresponding one of said photosensitive means for responding to pulse signals generated thereby, said signal conditioning circuit means emitting signals in response to photosensitive means signals having frequency and amplitude characteristics indicative of generation in response to traversal of a yarn by the respective one of said fields of view, and coincidence circuit means electrically connected to said signal conditioning circuit means and responsive thereto for emitting a yarn present signal upon receipt of conditioned signals from each of said photosensitive means within a predetermined short interval of time, said coincidence circuit means having a pair of multivibrator means each responsive to a conditioned signal from a corresponding one of said photosensitive means for setting a predetermined duration for each such conditioned photosensitive means signal and gate means electrically connected to said multivibrator means for distinguishing between (a) signalling from both said photosensitive means within said predetermined duration and indicative of the presence of a yarn and (b) signalling from only one of said photosensitive means within said predetermined duration and indicative of a fluctuation in ambient lighting or apparatus reflection.

* * * * *

UNITED STATES PATENT AND TRADEMARK OFFICE

CERTIFICATE OF CORRECTION

PATENT NO. : 4,112,665

DATED : September 12, 1978

INVENTOR(S) : Lyman L. Werst

It is certified that error appears in the above-identified patent and that said Letters Patent are hereby corrected as shown below:

Abstract, Line 2 "ttextilestrand" should be textile strand

Column 1, Line 13 after the word response insert - thereof. Examples of such apparatus and methods and related detector -

Column 5, Line 1 after the word said insert - common -

Signed and Sealed this

*Third* Day of *April 1979*

[SEAL]

*Attest:*

RUTH C. MASON
*Attesting Officer*

DONALD W. BANNER
*Commissioner of Patents and Trademarks*